US011723447B2

(12) United States Patent
Yang

(10) Patent No.: US 11,723,447 B2
(45) Date of Patent: Aug. 15, 2023

(54) PORTABLE EATING UTENSIL

(71) Applicant: Shang Quan Industrial Co., Ltd., Tainan (TW)

(72) Inventor: Sheng-Chuan Yang, Tainan (TW)

(73) Assignee: Shang Quan Industrial Co., Ltd., Tainan (TW)

( * ) Notice: Subject to any disclaimer, the term of this patent is extended or adjusted under 35 U.S.C. 154(b) by 0 days.

(21) Appl. No.: 17/661,289

(22) Filed: Apr. 29, 2022

(65) Prior Publication Data

US 2023/0140816 A1 May 4, 2023

(30) Foreign Application Priority Data

Nov. 3, 2021 (TW) ..... 110141018

(51) Int. Cl.
*A45C 11/24* (2006.01)

(52) U.S. Cl.
CPC ..... *A45C 11/24* (2013.01)

(58) Field of Classification Search
CPC .. A47G 21/02; A47G 21/06; A47G 2021/002; A47G 21/04; A47G 21/023; A47G 29/08; A45C 11/20; B26B 5/00; A45F 5/00; A45F 3/46; B65D 51/246; B65D 45/00; B65D 51/247
USPC .... 206/553, 541, 564, 38, 372, 494; 30/147, 30/150, 322, 143, 324, 326; 220/212, 220/574.1; D7/637, 653, 642
See application file for complete search history.

(56) References Cited

U.S. PATENT DOCUMENTS 4,389,777 A * 6/1983 Landsberger ..... B25G 1/10 30/340
4,539,749 A * 9/1985 Hyeong-Woon ..... A47G 21/06 30/162
4,599,797 A * 7/1986 Bax ..... A47G 21/026 30/323
5,197,623 A * 3/1993 Wang ..... B65D 51/246 206/542
5,261,560 A * 11/1993 Wang ..... A47G 21/06 206/553
5,669,143 A * 9/1997 Wu ..... A47G 21/02 30/322
5,950,280 A * 9/1999 Taylor ..... A47G 21/08 16/DIG. 18
5,966,814 A * 10/1999 Lin ..... A47G 21/02 30/142

(Continued)

*Primary Examiner* — Steven A. Reynolds
*Assistant Examiner* — Prince Pal
(74) *Attorney, Agent, or Firm* — CKC & Partners Co., LLC

(57) ABSTRACT

A portable eating utensil includes first and second shells, which is docked to accommodate an eating utensil. The first shell includes a first slot and a first protrusion on a side facing the second shell. The second shell includes a movable buckle. The buckle includes a second slot and a second protrusion on a side facing the first shell. When the first and second shells are docked, the buckle is moved to an unlocked position, such that the first protrusion leaves the second slot, the second protrusion leaves the first slot, and the first protrusion leaves the second protrusion to unlock the first and second shells. The buckle is moved to a locked position, such that the first protrusion is embedded into the second slot, the second protrusion is embedded into the first slot, and the first and second protrusions prop against to fix the first and second shells.

7 Claims, 12 Drawing Sheets

(56) References Cited

U.S. PATENT DOCUMENTS

| | | | | | |
|---|---|---|---|---|---|
| 5,992,667 | A * | 11/1999 | Huang | A47G 21/02 | 206/541 |
| 6,105,259 | A * | 8/2000 | Meyers | A47G 21/02 | 30/326 |
| 7,805,843 | B2 * | 10/2010 | Landsberger | B26B 5/00 | 30/142 |
| 8,905,668 | B2 * | 12/2014 | Edmondson | A45D 34/04 | 401/219 |
| 9,771,188 | B2 * | 9/2017 | Glassman | A47G 29/08 | |
| 11,109,700 | B2 * | 9/2021 | Henry | A47G 21/04 | |
| 11,484,136 | B2 * | 11/2022 | Chuang | A47G 21/023 | |
| 2002/0073553 | A1 * | 6/2002 | Yang | A47G 21/06 | 30/151 |
| 2006/0174489 | A1 * | 8/2006 | Kohler | A45C 11/20 | 30/143 |
| 2008/0066317 | A1 * | 3/2008 | Landsberger | A47G 21/02 | 30/142 |
| 2008/0276461 | A1 * | 11/2008 | Gold | A47G 23/12 | 30/142 |
| 2014/0173909 | A1 * | 6/2014 | Chong | A47G 21/06 | 30/150 |
| 2014/0332439 | A1 * | 11/2014 | Glassman | A47G 21/02 | 206/553 |
| 2015/0014329 | A1 * | 1/2015 | Konopatsky | A47G 21/06 | 220/574 |
| 2019/0099024 | A1 * | 4/2019 | Bessac | A47G 21/06 | |
| 2021/0007519 | A1 * | 1/2021 | Chang | A47G 21/103 | |
| 2021/0030177 | A1 * | 2/2021 | Henry | A47G 21/04 | |
| 2021/0047092 | A1 * | 2/2021 | Taylor | A47G 21/14 | |

* cited by examiner

PORTABLE EATING UTENSIL

RELATED APPLICATION

This application claims priority to Taiwan Application Serial Number 110141018, filed Nov. 3, 2021, which is herein incorporated by reference.

BACKGROUND

Technical Field

The present invention relates to an eating utensil, and more particularly, to a portable eating utensil.

Description of Related Art

In recent years, the environmental consciousness of people has increased, many people no longer use disposable eating utensils while eating out and carry reusable and washable eating utensils for own use instead. For convenience of carrying, the industry further developed an eating utensil which can be folded to reduce the volume, in order to place it into a carrying bag or pocket. For instance, the portable tableware disclosed in the utility model patent publication No. M601059 is used as tableware by fixing a spoon or a fork to an outer shell. The spoon and the fork can be removed from the outer shell after using, and be placed in the outer shell for storage.

In the aforementioned conventional structure, the outer shell is composed of two half shells docked to each other, and each of the half shells is provided with a fastener. Accordingly, the two half shells are combined and fixed to each other through the fasteners after they closed to prevent unexpected opening. However, there are four fasteners in the aforementioned conventional structure disposed on a left side and a right side of each half shell respectively, and they need to be fastened to each other while using, so the operation is more complicated. Furthermore, the fasteners are revealed on the outer side of the outer shell, so they are easy to be unfastened accidentally or even fractured due to collision with external objects, resulting in the inconvenience of using and easy damage.

Accordingly, the primary objective of the present invention is how to improve the aforementioned problems.

SUMMARY

The main objective of the present invention is to provide a portable eating utensil, which utilizes a movable buckle to instantly lock or unlock a shell, and a structure used to lock the buckle is hided inside to prevent accidental unfastening resulted from collision, thereby improving the convenience of using.

Another objective of the present invention is to combine two kinds of eating utensils together and carry them, thereby improving the convenience of storage, and significantly reducing the easy loss of the eating utensils resulted from carrying them separately.

To achieve the aforementioned objectives, the present invention provides a portable eating utensil including a first shell and a second shell, wherein they can be docked to enclose an accommodating room, the accommodating room accommodates an eating utensil, wherein the portable eating utensil is characterized in that:

the first shell is provided with a first slot and a first protrusion on a side facing the second shell, and the second shell is provided with a buckle which can move between a locked position and an unlocked position, the buckle is provided with a second slot and a second protrusion on a side facing the first shell, and when the first shell and the second shell are docked to each other, and the buckle is moved to the unlocked position, the first protrusion leaves the second slot, the second protrusion leaves the first slot, and the first protrusion leaves the second protrusion at the same time to unlock the first shell and the second shell; and when the buckle is moved to the locked position, the first protrusion is embedded into the second slot, the second protrusion is embedded into the first slot, and the first protrusion and the second protrusion prop against each other at the same time to fix the first shell and the second shell.

Preferably, the second shell is provided with a convex chuck on a side facing the first shell, the buckle is provided with a slotted hole put around the convex chuck, the buckle can move relative to the convex chuck, and positions of the buckle when the convex chuck is located at two ends of the slotted hole are defined as the locked position and the unlocked position respectively.

Preferably, a stop portion is disposed on a top of the convex chuck and extends above an edge of the slotted hole.

Preferably, a pivotal shaft is disposed on a top of the convex chuck, the eating utensil includes a functional end portion for taking food and a connection end portion, and there is a pivoting portion between the functional end portion and the connection end portion and pivotally disposed on the pivotal shaft, and the functional end portion or the connection end portion can be selectively moved out of the accommodating room by pivotally rotating the eating utensil.

Preferably, the functional end portion of the eating utensil is a spoon or a fork.

Preferably, the portable eating utensil further includes a sheath having a body provided with two combining portions, the eating utensil being detachably combined with one of the combining portions by the connection end portion, a skirt cover which is capable of moving back and forth along the body being disposed on the body, an accommodating room being formed between the skirt cover and the body, and the skirt cover can selectively move to a first position to enable the connection end portion and the combining portions to be stored in the accommodating room, and can selectively move to a second position to enable the connection end portion and the combining portions to leave the accommodating room.

Further, each of the combining portions is a pillar standing on the body, a through hole which can be put around the pillar is disposed on the connection end portion of the eating utensil, and a flange used for prohibit the connection end portion from detaching is disposed on an end of the pillar.

Further, a locating portion having a flexibility is disposed on the skirt cover, a first locating hole and a second locating hole are disposed on the body, when the skirt cover moves to the first position, the locating portion props against the first locating hole and locates the skirt cover; and when the skirt cover moves to the second position, the locating portion props against the second locating hole and locates the skirt cover.

It is easy to deeply realize the aforementioned objectives and the advantages of the present invention from the detailed description and the accompanying drawings of the following selected embodiments.

DETAILED DESCRIPTION

Figure 1:
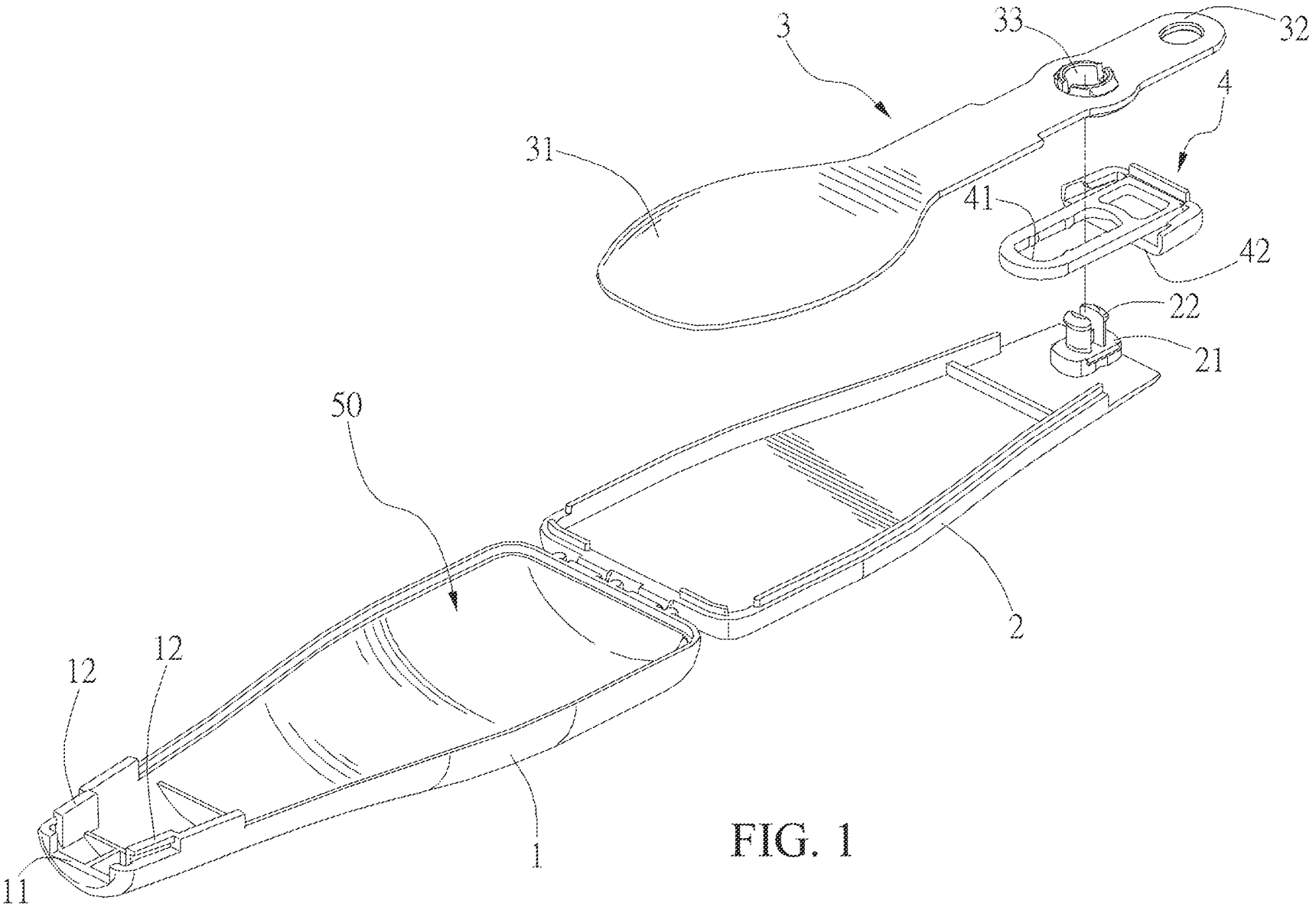
FIG. 1 is a schematic exploded three-dimensional diagram of a first embodiment of the present invention.

Referring to FIG. 1, which shows a first embodiment of a portable eating utensil provided by the present invention. The portable eating utensil includes a first shell 1 and a second shell 2 which can be docked to each other to enclose an accommodating room 50, and the accommodating room 50 may accommodate an eating utensil 3. The aforementioned first shell 1 and the second shell 2 are connected to each other through one of their ends respectively, in which the connecting ends of the shells may be pivoted by a pivot shaft, or may be connected by a foldable integral structure, such that the first shell 1 and the second shell 2 can be relatively pivoted to be close to and to be engaged with each other.

Figure 2:
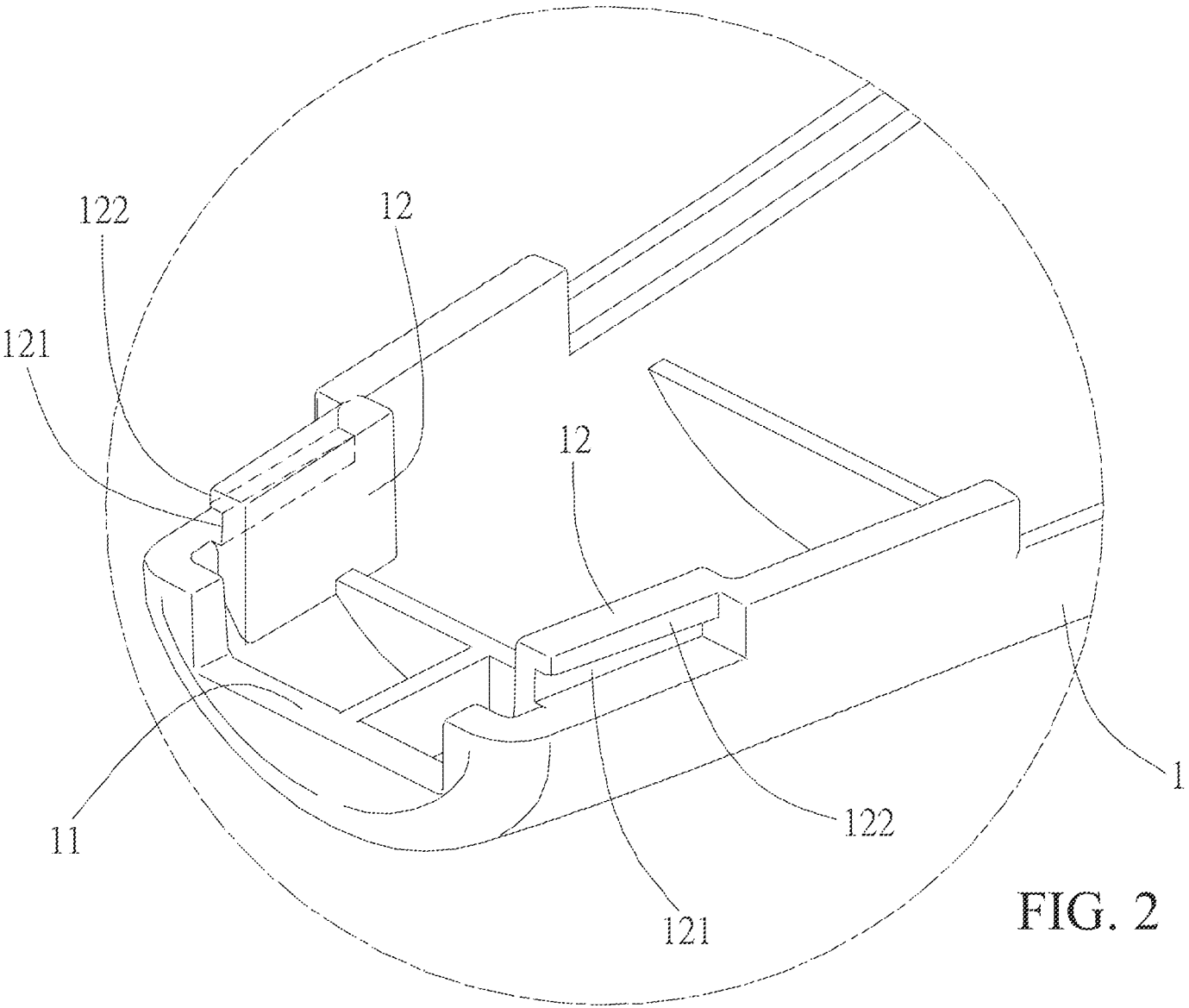
FIG. 2 is an enlarged schematic diagram of an A portion in FIG. 1.

As shown in FIG. 1 and FIG. 2, one end of the first shell 1 away from the connection with the second shell 2 is provided with an opening 11 for the eating utensil 3 to stretch out, and the first shell 1 includes two side blocks 12 respectively disposed on a right side and a left side behind the opening 11. A top side of each side block 12 protrudes outward, in which a relatively concave is defined as a first slot 121, and a relatively convex is defined as a first protrusion 122. Furthermore, in the present embodiment, the aforementioned first slots 121 and the first protrusions 122 are located on a side of the first shell 1 facing the second shell 2.

Figure 3:
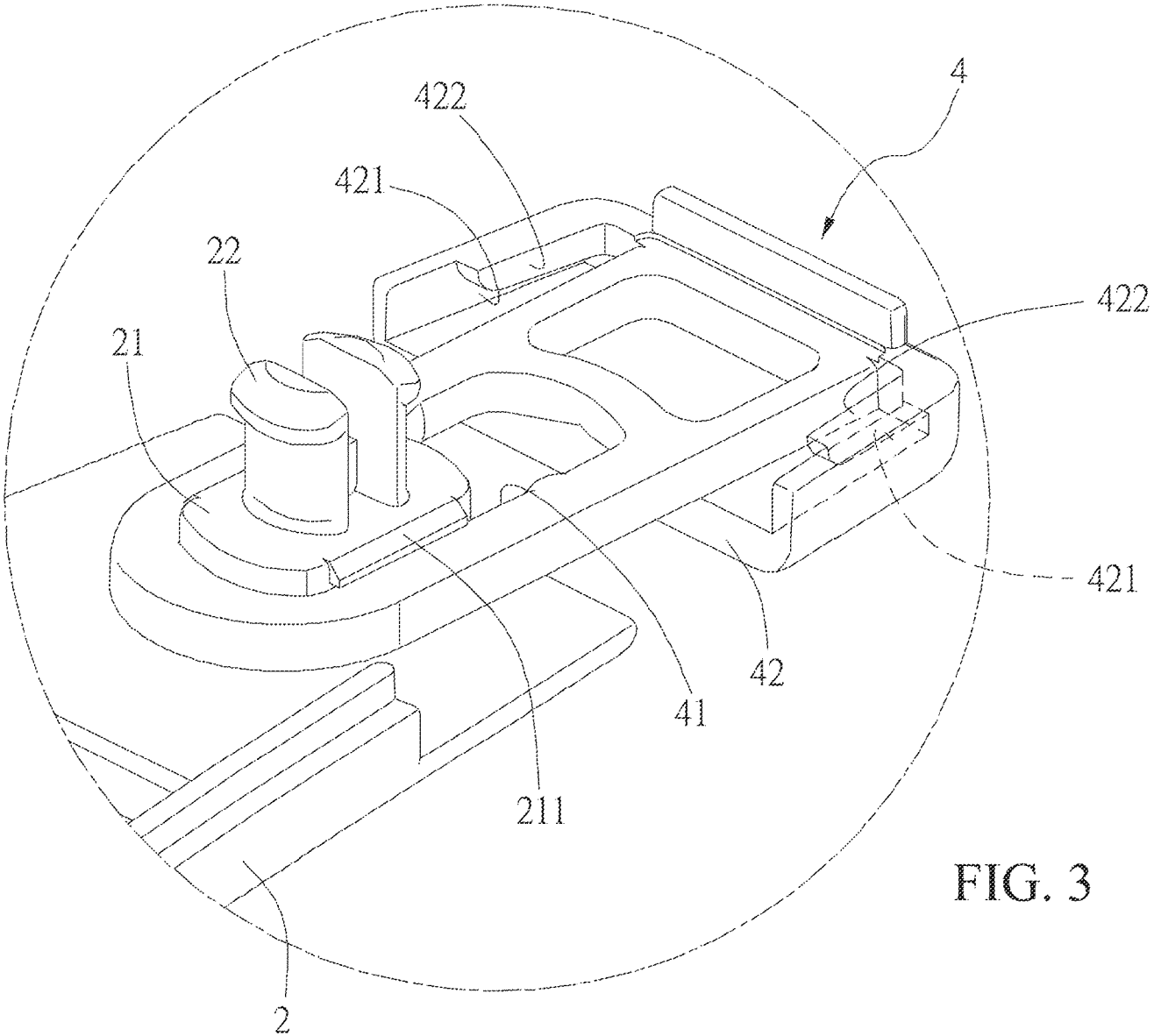
FIG. 3 is an enlarged schematic diagram of a B portion in FIG. 1.

As shown in FIG. 1 and FIG. 3, a convex chuck 21 is disposed on an end of the second shell 2 away from the connection with the first shell 1 and protruding toward the first shell 1, and a pivotal shaft 22 disposed is on a top of the convex chuck 21 for connecting the eating utensil 3. The eating utensil 3 has a functional end portion 31 for taking food (such as a spoon, a fork, or other structure used to take food) and a connection end portion 32, and a pivot portion 33 is disposed between them. The eating utensil 3 is pivotally disposed on the pivotal shaft 22 through the pivot portion 33. Accordingly, the functional end portion 31 or the connection end portion 32 may be selected to move out of the accommodating room 50 by pivotally rotating the eating utensil 3.

A movable buckle 4 is connected to the second shell 2. The buckle 4 has a slotted hole 41 put around the convex chuck 21 so as to make the buckle 4 be able to move forward and backward in a range of the slotted hole 41, in which the buckle 4 is defined to be at a locked position or an unlocked position as the convex chuck 21 is located at two ends of the slotted hole 41. In the present embodiment, a stop portion 211 is disposed on a top of the convex chuck 21 and extends above an edge of the slotted hole 41, thereby preventing the buckle 4 from being separated from the convex chuck 21 to ensure that the buckle 4 works normally.

A cover plate 42 is disposed on an end of the buckle 4 away from the slotted hole 41. A left side and a right side of the cover plate 42 stretch inward respectively, in which the relative concave is defined as a second slot 421, and the relative convex is defined as a second protrusion 422.

Figure 4:
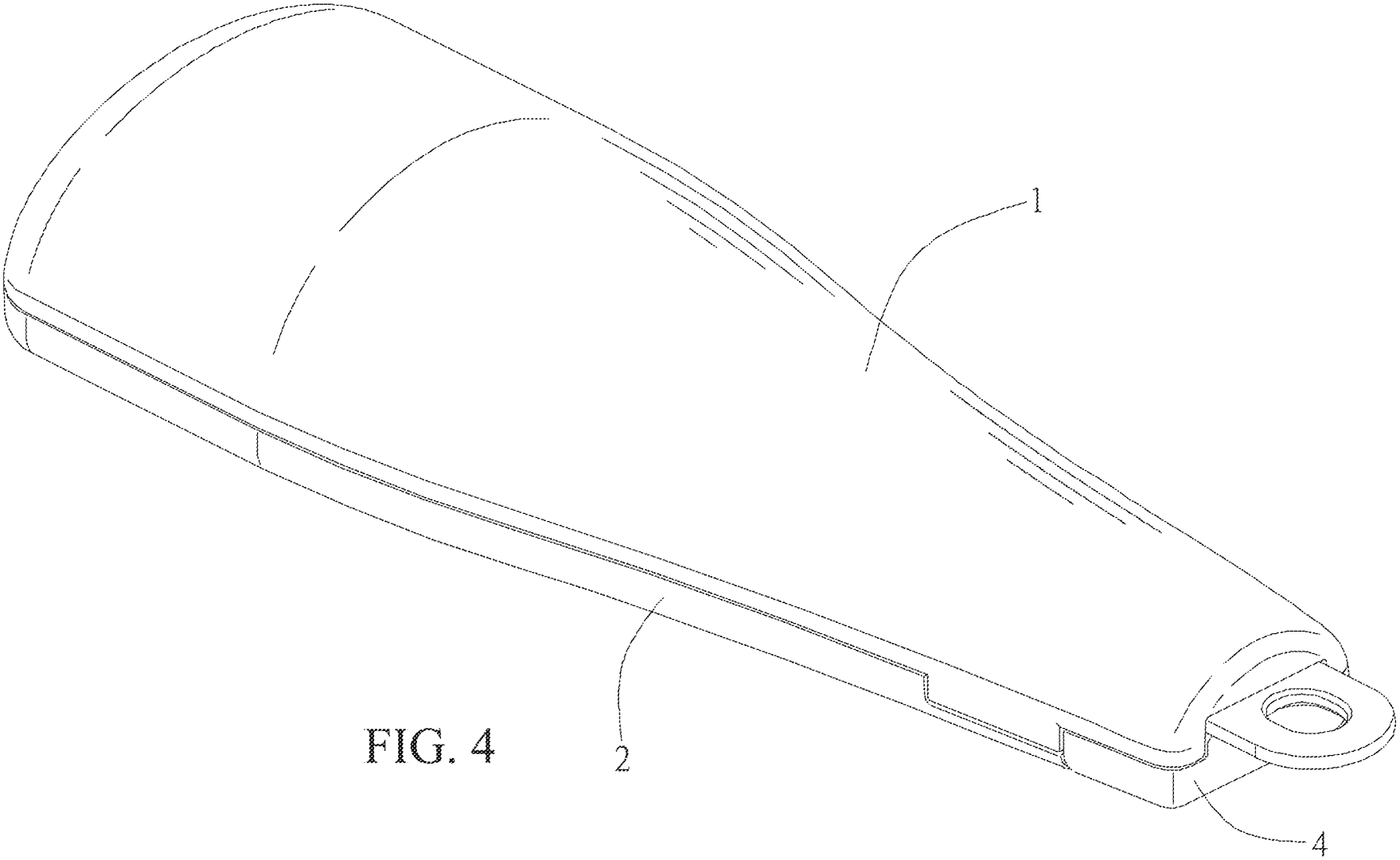
FIG. 4 is a schematic diagram showing a using state of the first embodiment of the present invention, which shows that the buckle is located at a locked position.
Figure 5:
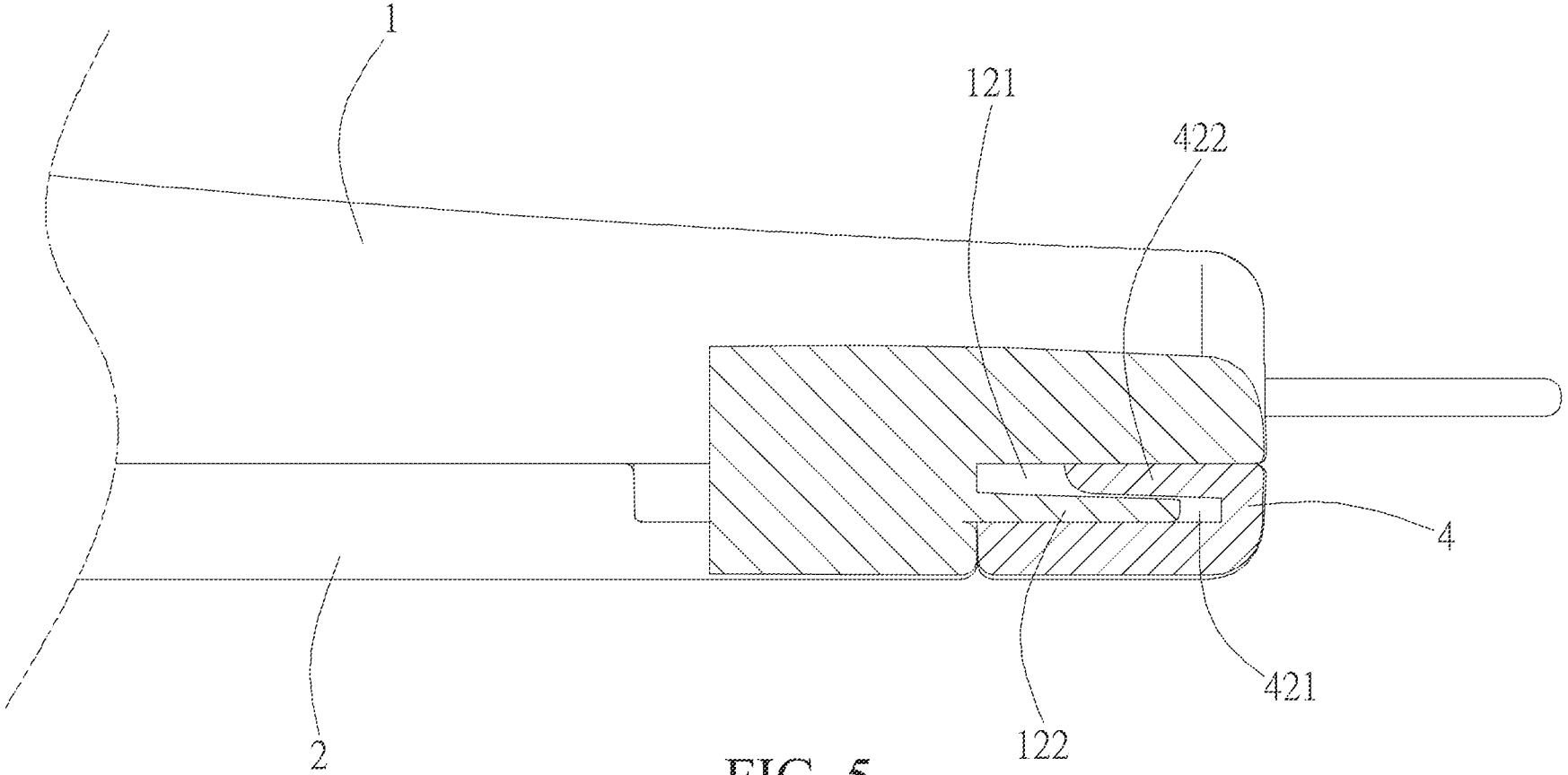
FIG. 5 is a schematic cross-sectional view of the present invention in the state as shown in FIG. 4.

When the first shell 1 and the second shell 2 are relatively pivoted to be close to and to be engaged with each other, the buckle 4 is moved to the locked position as shown in FIG. 4 and FIG. 5, the buckle 4 is embedded into the first slot 121 of the first shell 1 through the second protrusion 422, and the second slot 421 is embedded by the first protrusion 122 of the first shell 1, and at the same time, the first protrusion 122 and the second protrusion 422 block each other, such that the first shell 1 and the second shell 2 cannot be pivoted away relative to each other, and the first shell 1 and the second shell 2 are fixed to keep closed.

Figure 6:
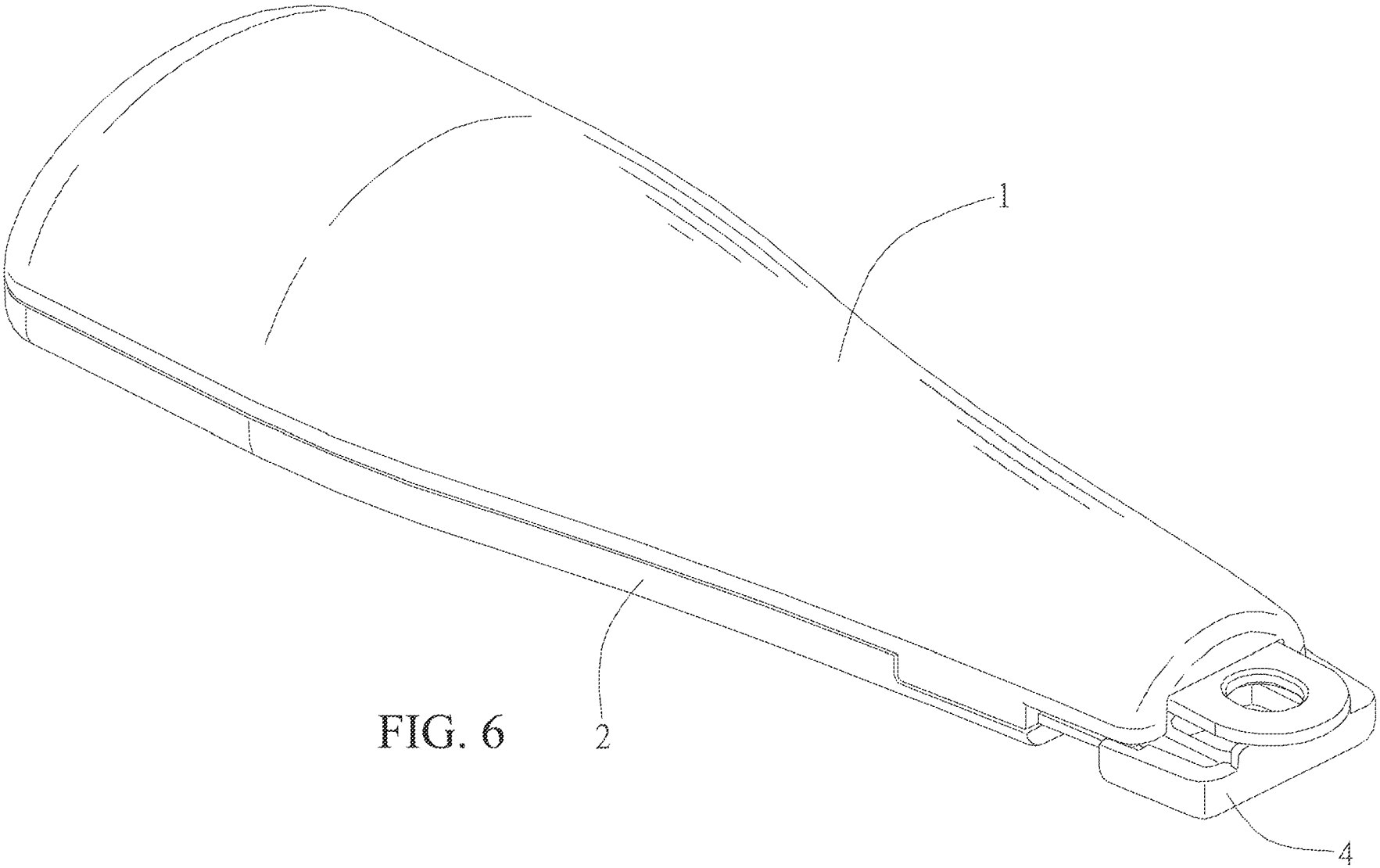
FIG. 6 is a schematic diagram showing a using state of the first embodiment of the present invention, which shows that the buckle is situated at the unlocked position.
Figure 7:
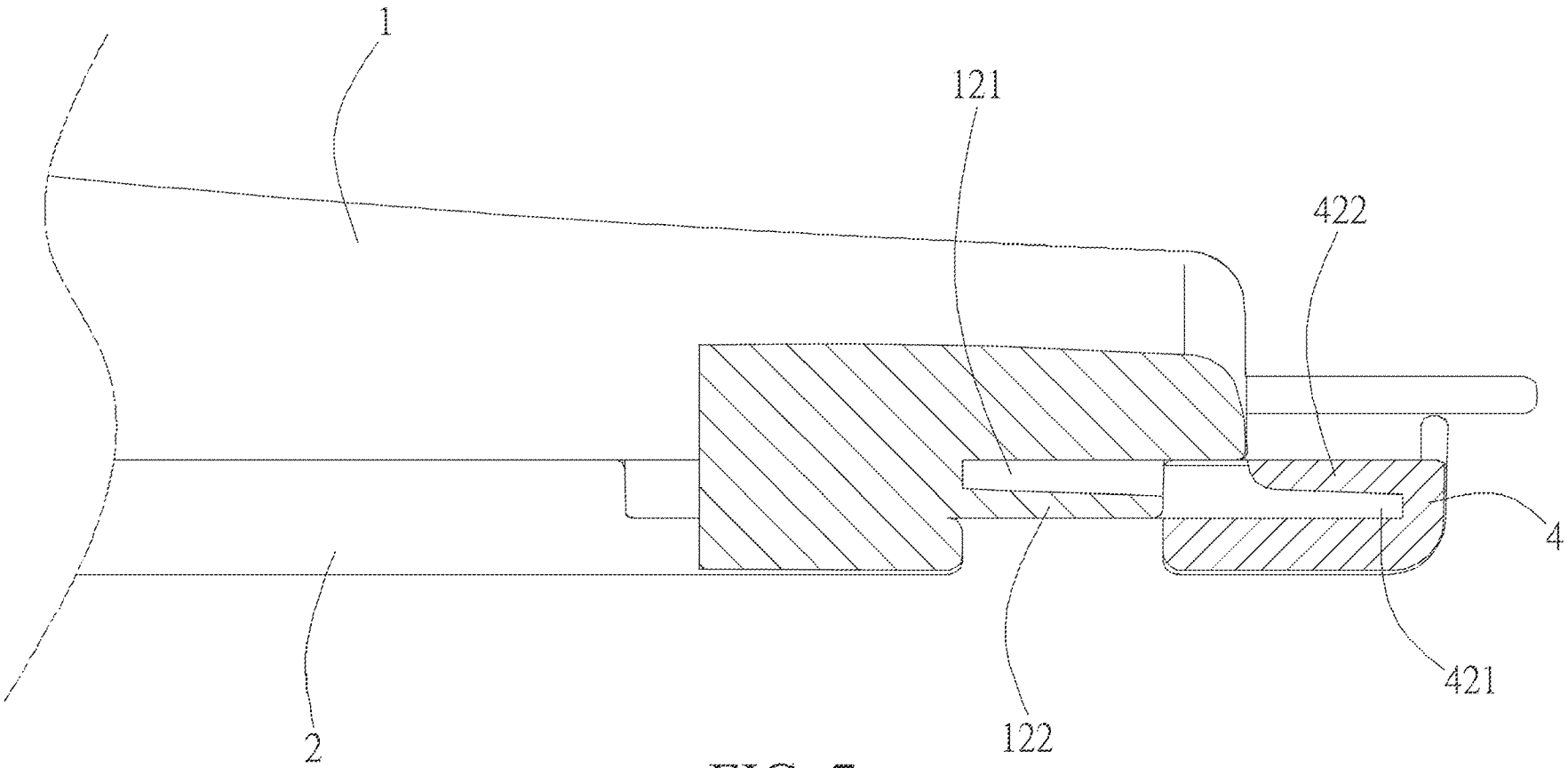
FIG. 7 is a schematic cross-sectional view of the present invention in the state as shown in FIG. 6.

On the other hand, when the first shell 1 and second shell 2 are to be opened, the buckle 4 is moved to the locked position as shown in FIG. 6 and FIG. 7, the second protrusion 422 of the buckle 4 leaves the first slot 121 of the first shell 1, and the second slot 421 is also away from the first protrusion 122 of the first shell 1 relatively. Accordingly, the second shell 2 obtains a degree of freedom to pivot away from the first shell 1.

By using the aforementioned structure, the present invention implements locking and unlocking between the first shell 1 and the second shell 2 by simply pushing the buckle 4, which is very convenient in operation. Furthermore, in the present invention, the structures used for locking the shells are all hidden inside the buckle 4 and is not exposed, hence the structures are not struck by external objects and unlock accidentally, and the appearance is kept simple and complete simultaneously.

Figure 8:
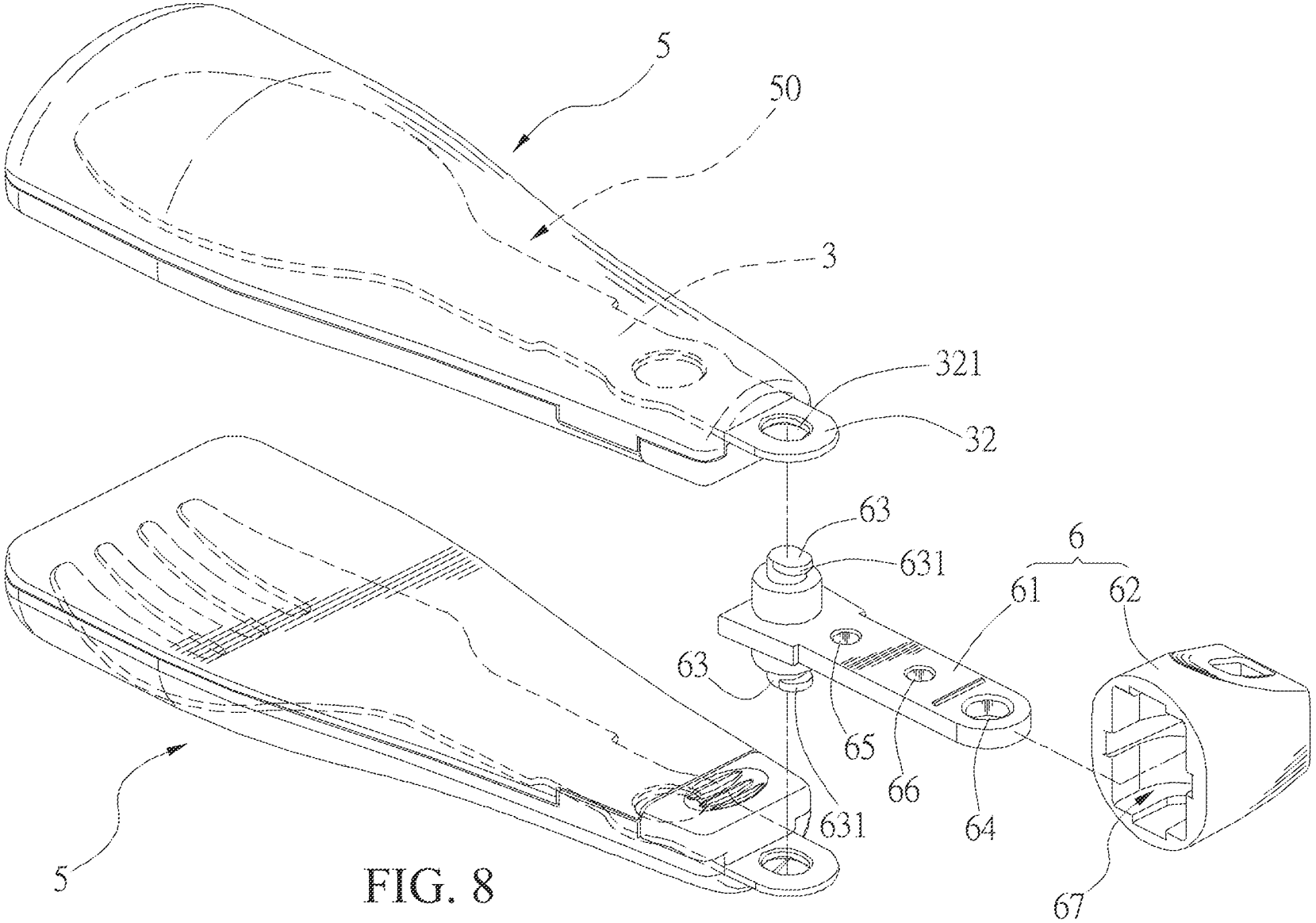
FIG. 8 is a schematic diagram of exploded three-dimensional decomposition of a present invention.

FIG. 8 shows a second embodiment of the present invention. The aforementioned entire structure of the first embodiment is defined as one eating utensil set 5, and the present embodiment is a convenient structure for assembling two eating utensil sets 5. The present embodiment includes two eating utensil sets 5 and a sheath 6, in which the eating utensils 3 in the two eating utensil sets 5 may be of the same type or different types, such as spoons, forks, or other structures used for taking food, and a through hole 321 is disposed on the connection end portion 32.

Figure 9:
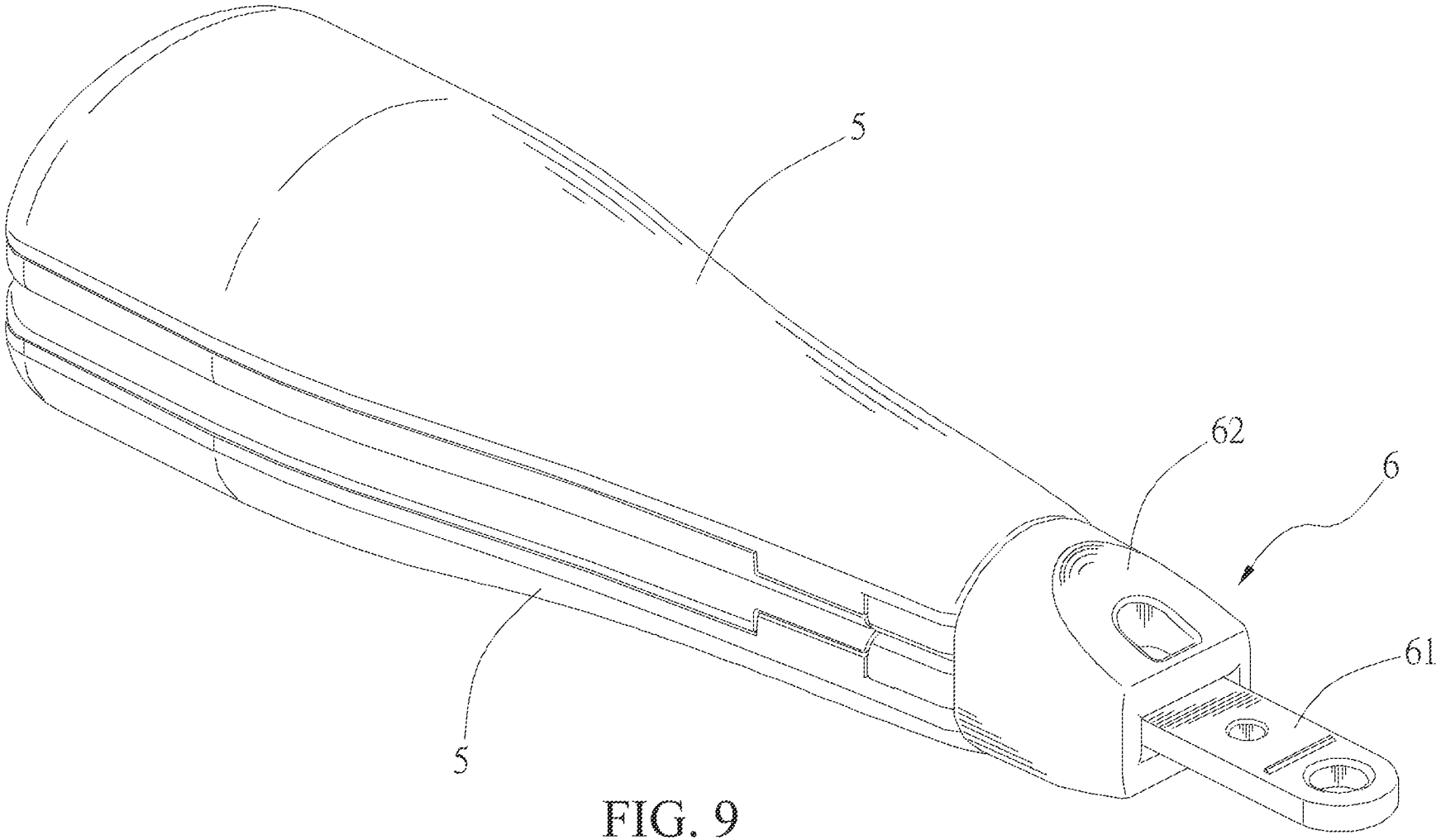
FIG. 9 is a schematic diagram showing a using state of the second embodiment of the present invention, which shows that the sheath is closed.

The sheath 6 includes a body 61 and a skirt cover 62. The body 61 is formed as a long plate, where a pillar 63 protrudes from each of two sides of one end of the body 61, and an end of the pillar 63 has a flange 631. The other end of the body 61 is provided with a hang hole for hanging, and the body 61 is provided with a first locating hole 65 and a second locating hole 66 between the hang hole 64 and the pillar 63. The skirt cover 62 is formed in a ring shape and is sleeved outside the body 61, and an accommodating space 67 is formed between the skirt cover 62 and the body 61. A flexible locating portion 68 protrudes from a side of the skirt cover 62 facing the body 61 toward the body 61 (referring to FIG. 10), and props against the body 61. The skirt cover 62 can slide forward along the body 61 to a first position as shown in FIG. 9, such that the pillar 63 is received into the accommodating space 67 and covered by the skirt cover 62 at this moment, and the locating portion 68 is propped in the first locating hole 65 to locate the skirt cover 62. The skirt cover 62 can slide backward along the body 61 to a second position as shown in FIG. 11, such that the pillar 63 leaves the accommodating space 67 and is exposed at this moment, and the locating portion 68 may be propped in the second locating hole 66 to locate the skirt cover 62.

Figure 10:
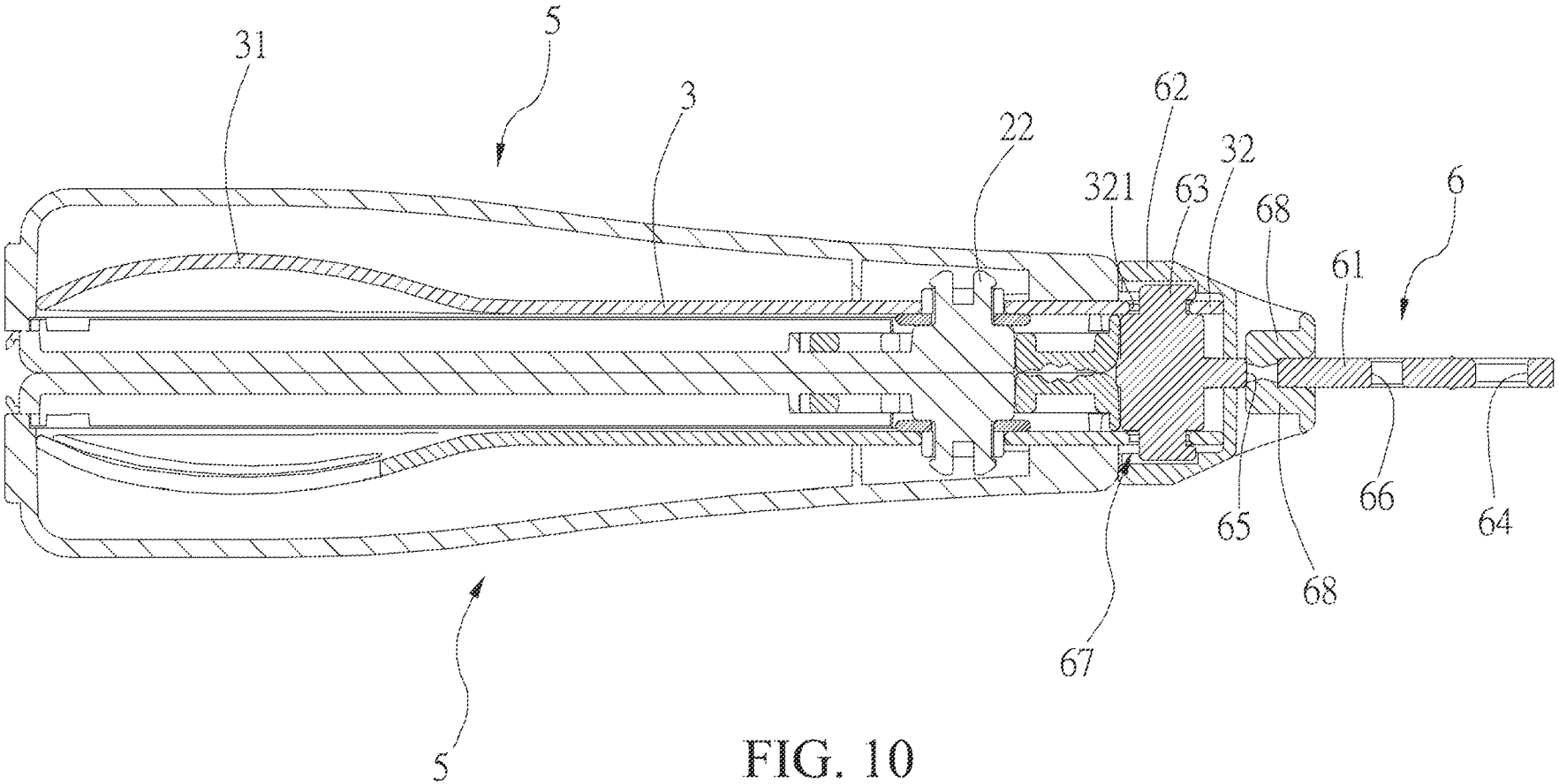
FIG. 10 is a schematic cross-sectional view of the present invention in the state as shown in FIG. 9.

With the aforementioned structure, the present embodiment can assemble the two portable eating utensil sets 5 together, and can achieve the effects of easy taking and loss reducing by centralized storage. Specifically, as shown in FIG. 8, after the functional end portion 31 of the eating utensil 3 of each eating utensil set 5 is included into the accommodating room 50, the connection end portions 32 protrude outside the accommodating room 50, and hence the through holes 321 of the connection end portions 32 can be put around the pillars 63 of the body 61 of the sheath 6 to combine the two eating utensil sets 5 on the sheath 6. Next, the skirt cover 62 is pushed along the body 61 to the first position as shown in FIG. 9 and FIG. 10, the locating portion 68 is locked in the first locating hole 65 for positioning, and hence the connection end portions 32 of the eating utensils 3 are included into the accommodating place 67 at this moment. In other words, the connection end portions 32 of the eating utensils 3 are covered by the skirt cover 62 to block the eating utensil sets 5 from leaving the pillars 63. Accordingly, the two eating utensil sets 5 are fixed and connected to the sheath 6 to generate the effect of centralized storage.

Figure 11:
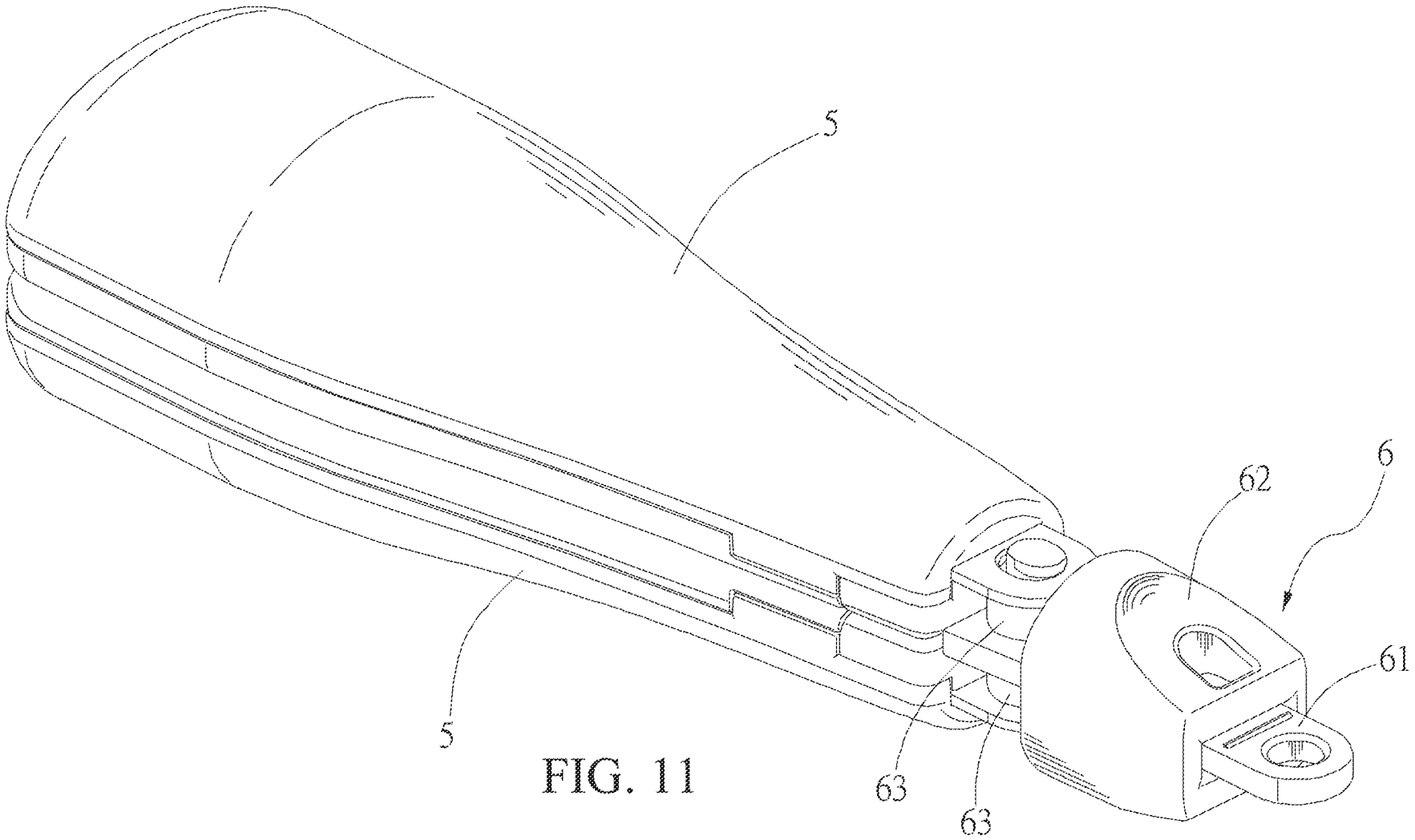
FIG. 11 is a schematic diagram showing a using state of the second embodiment of the present invention, which shows that the sheath is opened.
Figure 12:
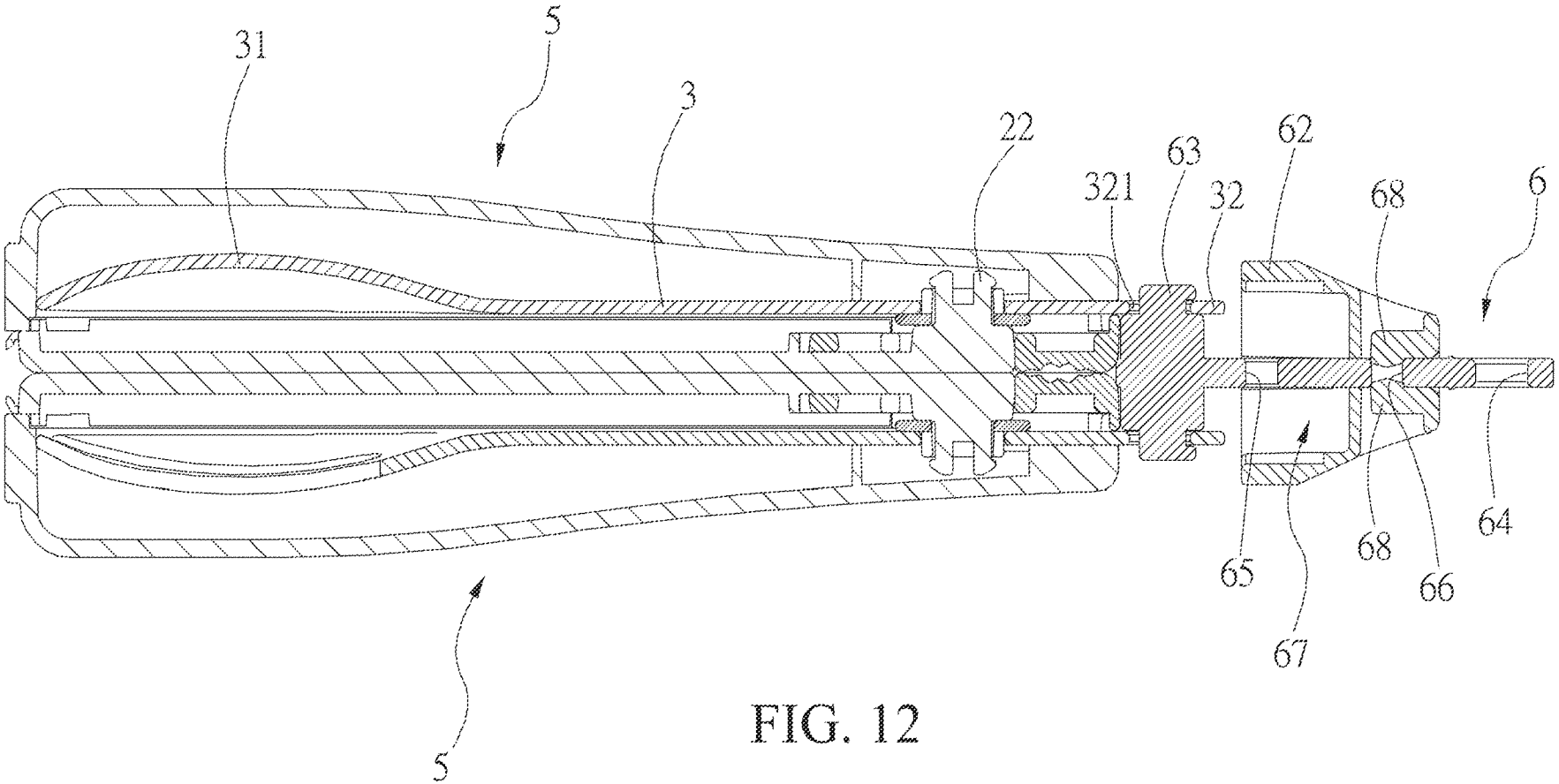
FIG. 12 is a schematic cross-sectional view of the present invention in the state as shown in FIG. 11.

When using the present invention to have food, as shown in FIG. 11 and FIG. 12, the skirt cover 62 is pushed along the body 61 to the second position, the locating portion 68 is locked in the second locating hole 66 for locating, and hence the connection end portions 32 of the eating utensils 3 leave the accommodating space 67 at this moment. In other words, the connection end portions 32 of the eating utensils 3 are exposed outside the skirt cover 62, and the two eating utensil sets 5 can be removed from the sheath 6. Next, referring to FIG. 6, after extracting the buckle 4 to unlock the first shell 1 and the second shell 2, the first shell 1 can be opened, the eating utensil 3 can be rotated to rotate out the functional end portion 31, the second shell 2 is covered with the first shell 1, the connection end portion 32 is clamped after inserting the buckle 4 to fix the eating utensil 3, and then the eating utensil 3 can be used to take food.

Comparing with the conventional structure, the feature of the present invention is that the two portable eating utensil sets 5 are assembled together to achieve the objective of centralized storage and generate the effect that is not easy to loss. When in use, it can be taken out and used according to the desired type of the eating utensil 3, and it is very easy and convenient in operation.

Nevertheless, the disclosure of the aforementioned embodiments is only used to illustrate the present invention, is not used to limit the present invention, and s the replacement of equivalent components should still within the scope of the present invention.

Based on the description above, it is apparent to those who skilled in the art that the present invention can clearly achieve the aforementioned objectives, and the present invention has already complied with the regulations of the patent law, therefore an application is filed in accordance with the law.

What is claimed is:

1. A portable eating utensil, comprising a first shell and a second shell, wherein the first shell and the second shell can be docked to enclose an accommodating room, the accommodating room accommodates an eating utensil, and wherein the portable eating utensil is characterized in that:

the first shell is provided with a first slot and a first protrusion on a side facing the second shell, the second shell is provided with a buckle which can move between a locked position and an unlocked position, the buckle is provided with a second slot and a second protrusion on a side facing the first shell, and when the first shell and the second shell are docked to each other, and the buckle is moved to the unlocked position, the first protrusion leaves the second slot, the second protrusion leaves the first slot, and the first protrusion leaves the second protrusion at the same time to unlock the first shell and the second shell; and when the buckle is moved to the locked position, the first protrusion is embedded into the second slot, the second protrusion is embedded into the first slot, and the first protrusion and the second protrusion prop against each other at the same time to fix the first shell and the second shell; and the second shell is provided with a convex chuck on a side facing the first shell, the buckle is provided with a slotted hole put around the convex chuck, the buckle can move relative to the convex chuck, and positions of the buckle when the convex chuck is located at two ends are defined as the locked position and the unlocked position respectively.

2. The portable eating utensil of claim 1, wherein a stop portion is disposed on a top of the convex chuck and extends above an edge of the slotted hole.

3. The portable eating utensil of claim 1, wherein a pivotal shaft is disposed on a top of the convex chuck, the eating utensil comprises a functional end portion for taking food and a connection end portion, there is a pivoting portion between the functional end portion and the connection end portion and pivotally disposed on the pivotal shaft, and the functional end portion or the connection end portion can be selectively moved out of the accommodating room by pivotally rotating the eating utensil.

4. The portable eating utensil of claim 3, wherein the functional end portion of the eating utensil is a spoon or a fork.

5. The portable eating utensil of claim 3, further comprising a sheath having a body provided with two combining portions, the eating utensil being detachably combined with one of the combining portions by the connection end portion, a skirt cover which is capable of moving back and forth along the body being disposed on the body, an accommodating space being formed between the skirt cover and the body, and the skirt cover can selectively move to a first position to enable the connection end portion and the combining portions to be stored in the accommodating room, and can selectively move to a second position to enable the connection end portion and the combining portions to leave the accommodating room.

6. The portable eating utensil of claim 5, wherein each of the combining portions is a pillar standing on the body, a through hole which can be put around the pillar is disposed on the connection end portion of the eating utensil, and a flange used for prohibit the connection end portion from detaching is disposed on an end of the pillar.

7. The portable eating utensil of claim 5, wherein a locating portion having a flexibility is disposed on the skirt cover, a first locating hole and a second locating hole are disposed on the body, when the skirt cover moves to the first position, the locating portion props against the first locating hole and locates the skirt cover; and when the skirt cover moves to the second position, the locating portion props against the second locating hole and locates the skirt cover.

* * * * *